United States Patent [19]

Agbay, Sr.

[11] Patent Number: 4,919,286

[45] Date of Patent: Apr. 24, 1990

[54] HINGED CLOSURE AND CONTAINER

[75] Inventor: Albert J. Agbay, Sr., Worcester, Mass.

[73] Assignee: Robert Linkletter Assoc., Shrewsbury, Mass.

[21] Appl. No.: 199,672

[22] Filed: May 27, 1988

[51] Int. Cl.[5] ..... B65D 41/34

[52] U.S. Cl. ..... 215/235; 215/254; 215/256

[58] Field of Search ..... 215/232, 235, 251, 252, 215/254, 256; 220/284

[56] References Cited

U.S. PATENT DOCUMENTS

| | | | |
|---|---|---|---|
| 3,272,368 | 9/1966 | Van Baarn | 215/235 |
| 3,811,597 | 5/1974 | Frankenberg et al. | 215/284 |
| 3,991,904 | 11/1976 | Davis et al. | 215/256 |
| 4,103,803 | 8/1978 | Irvine | 215/256 |
| 4,127,209 | 11/1978 | Ritzenhoff | 215/256 |
| 4,129,226 | 12/1978 | Percival | 215/235 |
| 4,311,247 | 1/1982 | Dembicki et al. | 215/232 |
| 4,378,892 | 4/1983 | Ochs et al. | 215/332 |
| 4,417,666 | 11/1983 | Roberts | 215/256 |
| 4,449,639 | 5/1984 | Davis | 215/256 |
| 4,625,875 | 12/1986 | Carr et al. | 215/232 |

*Primary Examiner*—Stephen Marcus

*Attorney, Agent, or Firm*—Blakely, Sokoloff, Taylor & Zafman

[57] ABSTRACT

An improved container and closure combination is described. The container has a variety of protrusions from its neck. The closure consists of a cap cover, a tear strip, a double-hinge, and an anchor band. The improvements of the closure include providing for a flexible valve seal, an easier removal apparatus for the tear strip, a self-aligning cap and a double lock bead system.

10 Claims, 5 Drawing Sheets

HINGED CLOSURE AND CONTAINER

BACKGROUND OF THE INVENTION

1. Field of the Invention.

This invention relates to the field of containers and closures. Specifically, a container-closure combination where the cap is secured physically to the container by an anchor band and hinge which connects the cap to the anchor band, thereby providing a hinged cap.

2. Prior Art.

This invention relates to a container and closure assembly in which the closure generally comprises a cap cover part, a tear-off strip, and an anchor band which, after the tear-off strip has been removed, is connected to the anchor band by a hinge. Closures of the above type have been widely used.

One example of a similar apparatus is disclosed in U.S. Pat. No. 3,991,904 ("Davis"). The Davis apparatus has such a combination of a cap cover, anchor band, and tear strip. The Davis apparatus does not provide for a tamper-evident closure of the type which includes an aluminum foil-like circular disc that is glued (or induction sealed) to the edges of the circular mouth of the container (and hence must be punctured or removed to get access to the contents of the container), as the bung of the closure in Davis prevents including such a tamper-evident disc or liner. Also, the tear strip of the Davis apparatus does not engage the bottle and therefore does not provide an additional affirmative contact between the closure and the bottle. In addition, the hinge described in Davis was a single strip of plastic that did not serve to align the cap cover with the container's mouth, as the extended bung of Davis was the main element contributing to the alignment between the cap cover and the mouth during the process of closing the container.

Certain problems are encountered in using hinged closures of this type. Many of the problems are due to the difficulty of reclosing the cap cover and with leakage of liquids from that cap cover. For example, it is difficult to produce plastics with the accuracy to form a tight seal on the closure, and the relocation of the anchor band can cause the cap cover to be out of alignment for proper closure. Moreover, the single plastic hinge does not perform well in impeding the twisting of the cap during reclosure, which twisting makes it difficult to align the cap with the container's mouth when closing the cap onto the container.

What is needed is a container with a hinged closure assembly that has a high quality of seal, is durable, and is easy to use. An object of the present invention is to provide for such an assembly. It is a further object of the present invention to provide a hinged closure having an anchor band which is connected to the cap cover by a double hinge; the cap cover includes an improved liquid sealing flange which does not preclude the use of the foil-like discs which improve the tamper evident qualities of the closure. It is a further object of the invention to provide a hinged closure having an anchor band, a tear strip and a cap cover, which closure, when it has never been opened, has improved security and liquid sealing capabilities due to a double lock bead system which includes, on one hand, a bead ("sealing rib") on the cap cover which engages and cooperates with a bead ("cap latch") on the upper end of the container's neck, and on the other hand, an inwardly facing circumferential bead ("locking bead") on the tear strip which engages and cooperates with an outwardly facing circumferential bead ("cap restraint") on the neck of the container.

SUMMARY OF THE INVENTION

The present invention provides an improved flexible valve seal between the closure and the container, as well as a double lock bead system in the neck of the container. These enhancements help to form a tighter, moisture-resistant seal and provide a more secure closure that resists forcible removal of the cap cover while the tear strip is in place. The invention also has other improvements that will become apparent from the detailed description.

A new tear tab design with a window adjacent to the tear tab on the tear strip allows for easier removal of the tear strip from the closure. The tear tab is connected to the tear strip. One end of the tear tab extends outwardly from the cap cover and anchor base to provide for a large area available to grip the tear tab to remove the tear strip. The window is located adjacent to the extension of the tear tab. The window is covered by thin membrane to prevent entry of dust, dirt and moisture. Yet the thin membrane is easily punctured both for ease of removal and to show evidence of any attempts to tamper with the closure. A new double hinge design creates a stronger hinge with more durability and improves the ease of reclosing the container/closure by effectively self-aligning the cap cover with the container's mouth. The hinged closure of the invention may be used with an aluminum foil-like disc or liner which is glued or otherwise attached to the edges of the circular mouth of the container.

The present invention involves tamper-evident closure and container combination. The container has a neck which terminates in a top rim which defines a mouth generally of circular shape. The neck also includes a flexible cap latch which generally surrounds circumferentially the top rim; the cap latch extends downwardly and outwardly from the top rim of the neck. The cap latch includes a horizontally projected base which will engage a portion of the cap cover to secure the cap onto the container.

The neck also includes a cap restraint which protrudes outwardly from the neck below the cap latch. Usually, the cap restraint circumferentially surrounds the neck and includes a downwardly slanting face and another horizontally projected base. The cap restraint and the cap latch form a cavity which typically surrounds circumferentially the entire neck of the container between the cap restraint and the cap latch. The neck also includes an anchor ceiling (or base ceiling) which protrudes outwardly from the neck below the cap restraint. Typically, the anchor ceiling circumferentially surrounds the entire neck. The anchor ceiling, together with the cap restrain form a groove which normally circumferentially surrounds the entire neck between the cap restrain and the anchor ceiling. The neck also includes an anchor floor (or base rest) which protrudes outwardly from the neck from below the anchor ceiling. Normally, the anchor floor circumferentially surrounds the entire neck circumference. The anchor ceiling and the anchor floor together form a depression which typically surrounds circumferentially the entire neck area between the anchor ceiling and the anchor floor. It will be appreciated that modification may be made to the cap restraint, the anchor ceiling and the anchor floor; for example, rather than extending the cap restraint completely around the neck of the container in circular fashion, a portion of a circular cap restraint may be utilized.

The closure of the invention comprises several elements, including a cap cover, an anchor band, a double hinge and a tear strip. The cap cover includes a generally circular top which covers the mouth of the container in which, in normal use, has a diameter larger than the outer diameter of the container. The cap cover includes an annular sidewall which projects downwardly from the circular top and which includes a flexible sealing rib which generally circumferentially surrounds the neck and which projects inwardly from the annular sidewall. The sealing rib has an inner diameter which is less than the outer diameter of the cap latch so that the sealing rib tightly engages and abuts the cap latch when the closure is closed. The sealing rib projects into the cavity created by the cap latch and the cap restraint. Typically, at least a portion of the sealing rib is located under the horizontally projected base of the cap latch when the closure is closed. The circular top includes a flexible external sealing flange which protrudes from the under side of the circular top; the external sealing flange normally surrounds circumferentially the top rim. Generally, the inner diameter of the sealing flange is only slightly greater than the outer diameter of the top rim so that, when the closure is closed, the external sealing flange tightly abuts the outer edge of the top rim to provide an effective liquid seal. If an aluminum foil-like disc or liner is used to cover the mouth of the container, the external sealing flange may provide an additional function by holding the disc or liner in place, especially prior to the bonding of the disc or liner onto the mouth of the bottle. The diameter of the disc (or liner) is made large enough so that the external sealing flange will tightly press down on the outer edge of the disc (or liner).

The closure also includes an anchor band which is typically an annular band which circumferentially surrounds and covers the depression around the neck formed between the anchor ceiling and the anchor floor. The anchor band normally includes a portion of the annular band which extends inwardly into the depression, which portion of the anchor band typically engages either the anchor ceiling or the anchor floor when movement of the anchor band is attempted. That is, the anchor band is secured in place in the depression by the anchor ceiling and the anchor floor. The anchor ceiling engages the anchor band to prevent upward movement and the anchor floor engages the anchor band to prevent downward movement of the anchor band. The anchor band is connected to the double hinge which overlies a portion of the groove. The double hinge normally includes two posts of flexible material (e.g. plastic) which are interconnected by a permanent membrane. Each posts has two ends, one of which is connected to the anchor band and the other end of which is connected to the cap cover. The hinge of the invention may be modified to utilize a single hinge rather than the double hinge construction described herein.

The tear strip of this closure includes a strip which circumferentially surrounds and covers most of the groove around the neck. In one embodiment, the strip of the tear strip usually circumferentially surrounds and covers all of the groove around the neck except for the portion of the groove behind the double hinge. The tear strip typically includes a thin membrane which connects both ends of the tear strip to the double hinge so that the tear strip and the double hinge completely cover the groove around the neck. The tear strip is connected to the cap cover by a thin frangible molding and is also connected to the anchor band by a thin frangible molding. Alternatively, the tear strip may be connected to the cap cover and the anchor band by frangible intermittant retainer nibs (rather than the thin frangible molding). The tear strip further includes a tear tab which protrudes outwardly from an end of the tear strip; the tear tab permits gripping the tear strip to thereby remove the tear strip by tearing it off of the closure. The frangible molding (or intermittent retainer nibs) connecting the tear strip to the anchor band and to the cap cover is torn upon removal of the tear strip. The tear strip includes an inwardly protruding locking bead over at least a portion of the interior surface of the tear strip. The locking bead abuts the cap restraint and protrudes into the groove so as to cooperatively engage the cap restraint to securely retain said cap cover on said container until the tear strip is removed from the closure.

The tear strip normally has two ends which are connected to the double hinge by two thin membranes. One end typically includes the tear tab. Alternatively, the tear strip may be connected at one end by a thin membrane to the double hinge and at the other end, where the tear tab is located, the groove may remain uncovered to form a window notch between the end of the tear strip having the tear tab and the double hinge.

The hinged closure and container of the invention may be used for container/closures of any size (e.g. height or diameter, etc.) and generally may be used with a wide variety of materials.

DETAILED DESCRIPTION OF THE PRESENT INVENTION

The present invention describes a container and a hinged closure. In the following description, numerous specific details are set forth in order to provide a thorough understanding of the present invention. It will be obvious, however, to those skilled in the art that the present invention may be practiced without these specific details. In other instances, well-known methods have not been described in detail so as not to unnecessarily obscure the present invention.

Figure 1:
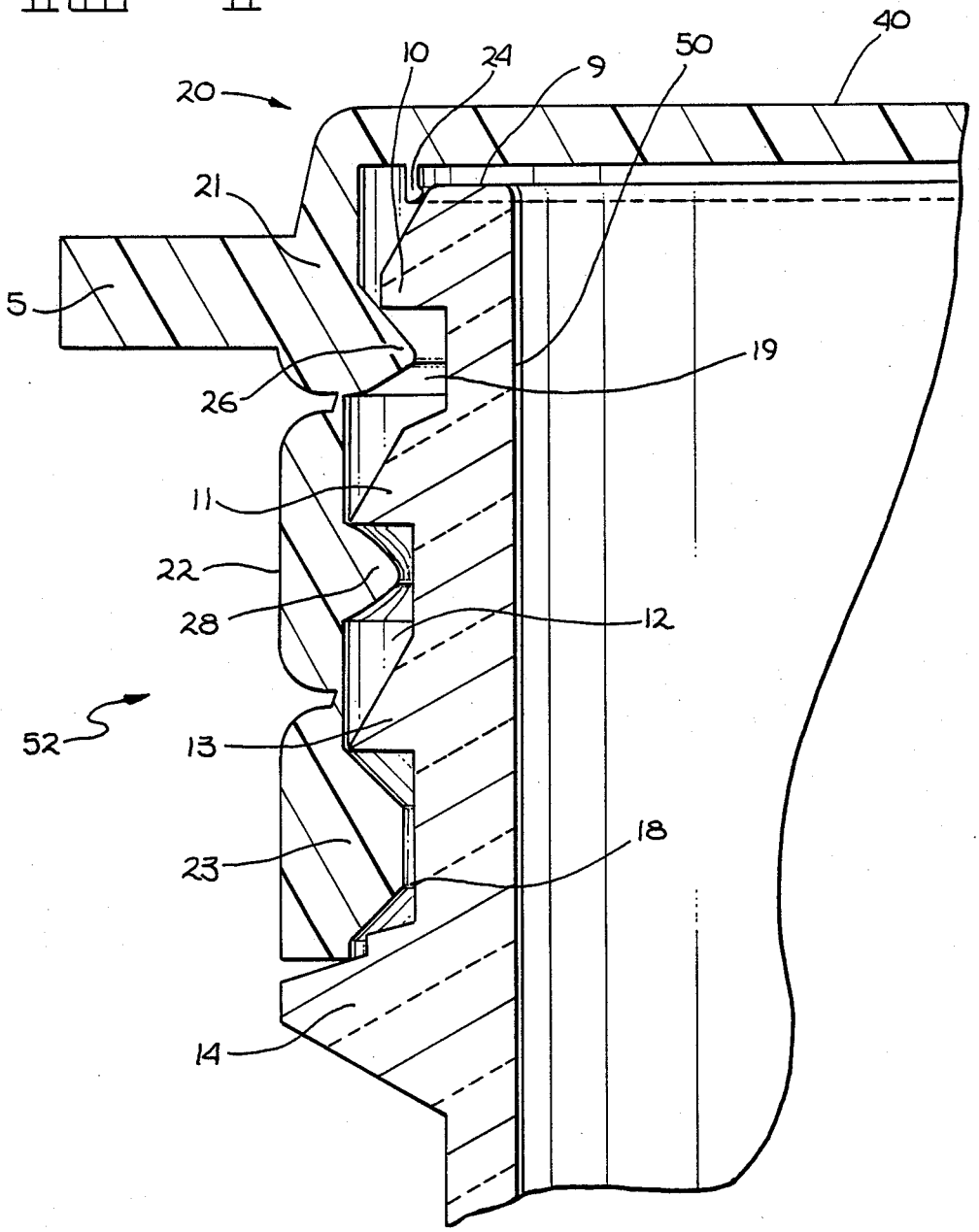
FIG. 1 is a cross-sectional view of a portion of the container neck and closure.

The present invention has been designed to provide a stronger base for the cap cover so as to both make the closure a more durable apparatus and to make the seal it forms with the container much stronger and more effective. The closure is dirt and moisture resistant as well as tamper evident. It also provides an easier opening mechanism for the ultimate consumer to utilize. FIG. 1 is a cross sectional view of neck 50 of container 51, with a closure, which includes the cap cover 20, anchor band 23, and tear strip 22, in a closed position on the container 51. Near the top rim 9 of the neck 50 is a cap latch 10 which is a flexible annular protrusion running externally outside the circular neck 50. The cap cover 20 is generally a plastic "snap cap" having a circular top 40 which cover the mouth of the container. The cap cover 20 includes an annular sidewall 21 which is connected to and projects downwardly from the circular top 40 of the cap cover 20. Near the bottom of the annular sidewall 21 is an inwardly extending circumferential sealing rib 26 which is designed to engage the cap latch 10 when the closure is closed to secure the cap onto the container. The inner diameter of the sealing rib 26 is less than the outer diameter of the cap latch 10 so that, when the cap cover 20 is snapped onto the container, the cap latch 10 and sealing rib 26 engage each other in a tightly fitting manner to provide an effective liquid seal. The cap cover 20 also includes a flexible exterior sealing flange 24 on the underside of the top 40 of the cap cover 20, which sealing flange 24 is generally a circular protrusion which extends from the underside of the cap cover 20. The exterior sealing flange 24 abuts the exterior portion of the top rim 9 of the container when the cap is closed. The top rim 9 and exterior sealing flange 24, in conjunction with the sealing rib 26 and the cap latch 10, form the flexible valve seal. The exterior sealing flange 24 abuts the top rim 9 of the neck externally, so that a foil-like tamper evident sealing disc or liner can be affixed to top rim 9 without any interference from the flange 24. Moreover, the exterior sealing flange 24 may hold the disc or line in place by pressing on the outer edge of the disc or liner.

Near the cap latch 10 is a cap restraint 11 which may extend slightly further out from the wall of the neck 50 than the cap latch 10. A cavity 19 is formed between the cap latch 10 and the cap restraint 11. This cavity 19 receives the inwardly facing circumferential sealing rib 26. The sealing rib 26 of the closure works in conjunction with the cap latch 10 to affix the cap cover 20 to the neck of the container. The exterior sealing flange 24 abuts the top rim 9 to further seal the cap cover 20 to the container. These elements create a flexible valve seal between the container and closure.

There are two other annular protrusions from the neck of the container which are shown in FIG. 1 as the base ceiling 13 (anchor ceiling) and base rest 14 (anchor floor). The base ceiling 13 is below the cap restrain 11 and extends out from the neck wall to a slightly lesser extent than the cap latch 10. The base rest 14 extends further than any of the other protrusions from the neck to form a ledge on which the anchor band 23 will rest.

Between the cap restrain 11 and the base ceiling 13 is a groove 12 that provides for an area behind tear strip 22. The groove 12 allows for a locking bead 28 to protrude inwardly from the tear strip 22 to form part of the double lock bead system. The double lock bead system of the invention improves the liquid sealing capabilities of the closure and improve the security (against tampering) of the closure because the locking bead 28/cap restraint 11 combination provides a lock for the closure in addition to the sealing rib 26/cap latch 10 combination. The double lock bead system comprises, on one hand, the sealing rib 26 on the cap cover 20 which rib engages and cooperates with the cap latch 10, and on the other hand, the locking bead 28 on the tear strip 22 which engages and cooperates with the cap restrain 11. The tear strip 22 will remain on the closure until the closure is first opened. Thus, the double lock bead system will improve the security of the closure because an additional lock assists against attempts to forcibly remove the cap cover 20. Moreover, the double lock bead system improves the liquid sealing capabilities because the one lock (the locking bead 28/cap restraint 11 combination) tends to make the other lock (the sealing rib 26/cap latch 10 combination) a tighter fit. The closure of the invention also has improved security and sealing because of other additional locks (in particular, the anchor band 23 cooperates with the base ceiling 13 and the base rest 14).

Figure 6:
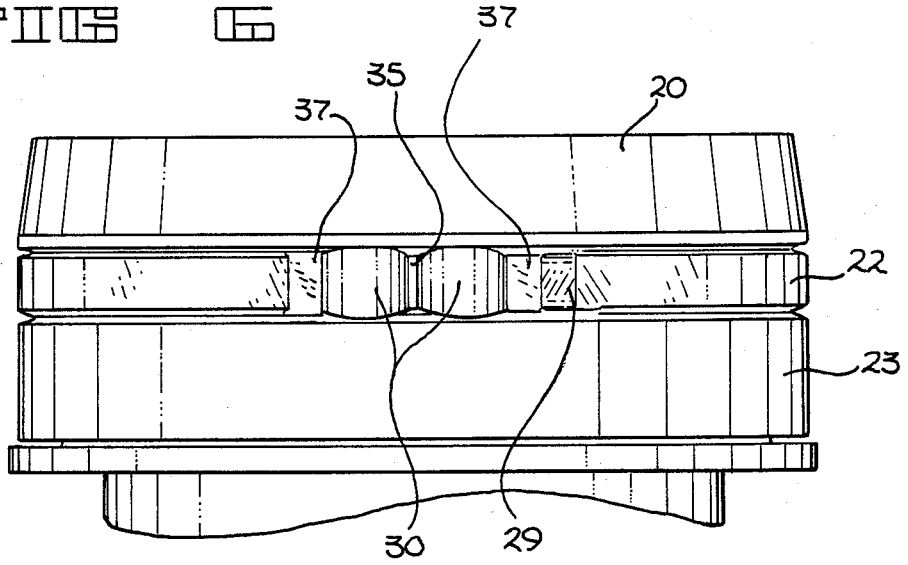
FIG. 6 is a view of the double hinge, the tear tab and the window.

The groove 12 also works in conjunction with the window 31 (with or without a thin membrane covering over the window) of FIG. 6 to provide for an opening in the tear strip 22. That allows for an apparatus such as a tool to aid in the removal of the tear strip 22 by permitting the insertion of the tool or other sharp article.

There is a depression 18 between the base ceiling 13 and the base rest 14 for an anchor band 23. The depression 18 should be as deep as anchor band 23 is thick. The base ceiling 13 must extend outward to provide sufficient area so as not to allow the anchor band to be removed. The base rest 14 is only necessary to support the anchor band 23 when the cap cover is open. The container 51 is usually much larger in diameter than the anchor band 23 so there is no danger of the anchor band 23 slipping off via the container 51.

The closure 52 consists of four parts. The cap cover 20 is the part of the closure 52 which goes over the top of the neck 50 of the container 51 and forms the flexible valve seal. On the bottom surface of the top 40, there is the exterior sealing flange 24 that acts to form a seal with the top rim 9 of the container. There is also a sealing rib 26 at the bottom of the interior of the cap cover shown in FIG. 1. There is no downward projection from the cap cover 20 that is internally situated in the neck 50 of the container 51. Generally, the only downward projections are the exterior sealing flange 24 and the annular sidewall 21. The exterior sealing flange 24 projects downwardly between the outer diameter of the top rim 9 and the inner diameter of the annular sidewall 21; generally, the inner diameter of the sealing flange 24 is only slightly greater than the outer diameter of the top rim 9. Thus, the exterior sealing flange 24 abuts the outer diameter of the top rim 9, helping to form the flexible valve seal. At the bottom of the annular sidewall 21 is a sealing rib 26 that abuts the cap latch 10 from underneath to help form the flexible valve seal. Also, on the cap cover 20 generally opposite of the position of the hinge is an opening tab 5. The opening tab is a projection for gripping the cap cover 20 for normal operation.

The second part of the closure 52 is the anchor band 23. The anchor band 23 is made to secure the cap 20 to the base of the neck of the container by meshing into the depression 18 between the base ceiling 13 and the base rest 14. The outward protrusion of both the base ceiling 13 and the base rest 14 work in conjunction to prohibit the anchor band 23 from being removed. In the preferred embodiment, the base rest protrudes outwardly from the outer surface of the neck 50 at least as far as the outer circumference of the anchor band 23. However, in order to allow for rotation of the closure, the base ceiling 13 preferably protrudes less further out to allow for a hinge to attach the anchor band 23 and the cap cover 20. In this fashion the interior surface of hinge 30 can be flush with the outer circumference of the base ceiling 13 and the exterior surface of hinge 30 can be flush with the outer circumference of the base rest 14, while still allowing for complete rotation of the closure 52 around the neck 50.

Figure 2:
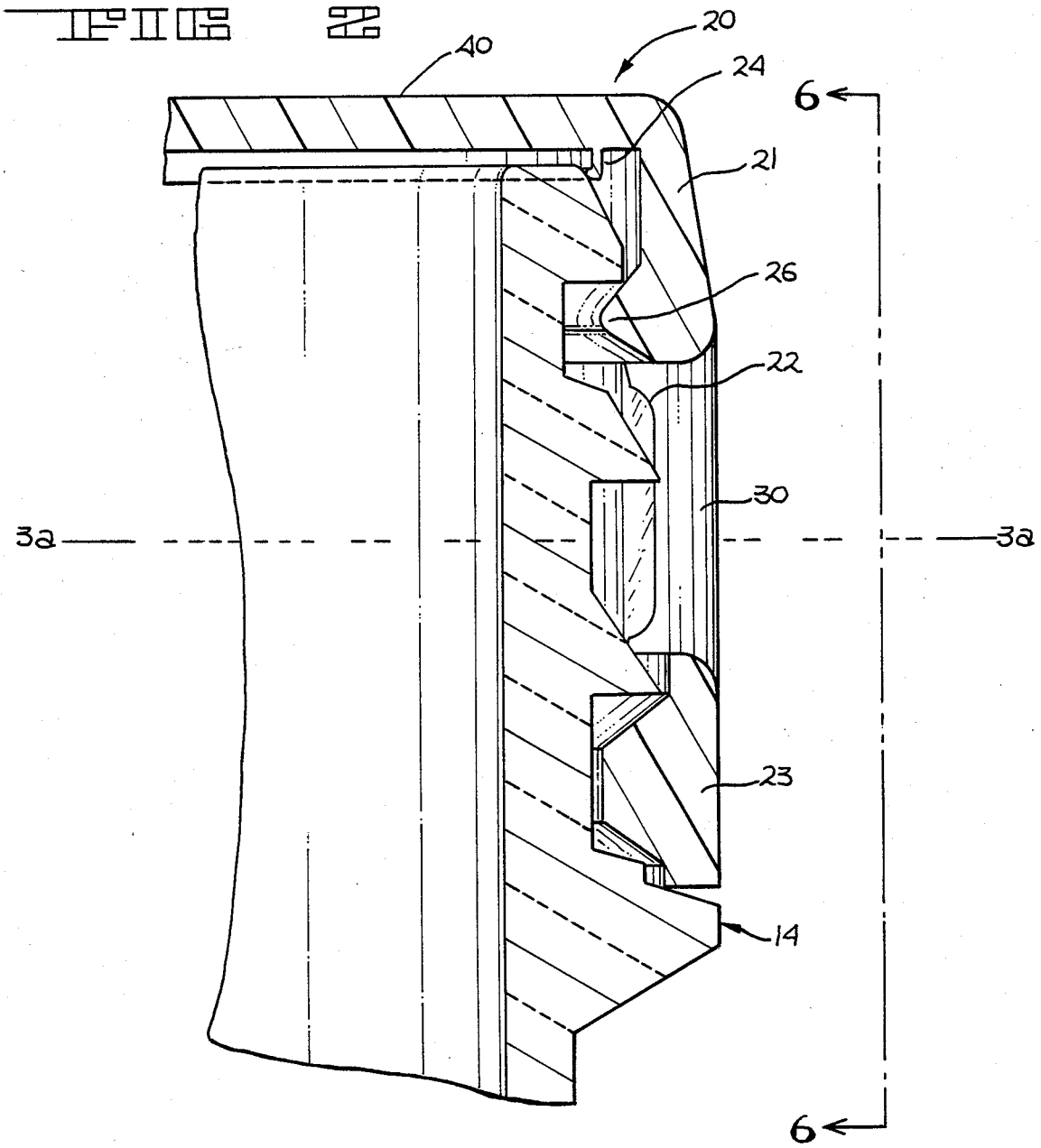
FIG. 2 is a cross-sectional view of the hinge area of the closure and the container neck taken from between the double hinges as shown in FIG. 3.

The cap cover 20 and the anchor band 23 are connected by the double hinge 30 in FIG. 2. The closures of the invention may use a single hinge if the advantages of the double hinge are not necessary. As in FIG. 1, the cap-cover 20 and the anchor band 23 attach to the neck 50 of the container 51. However, the hinge 30 does not interact with the neck 50 of the container 51. in fact, after the tear strip 22 is removed and the cap cover 20 is opened, the hinge 30 stays outside of the outer diameter of the neck 50 of the container 51.

The double hinge 30, as shown in FIG. 6, is comprised of two pillars (posts) which are connected to the anchor band 23 and to the cap cover 20. In between the two pillars of double hinge 30 is a thin membrane 35 generally of plastic that connects the pillars. Unlike thin plastic membrane 37, the thin membrane 35 is a permanent fixture. The hinges 30 are generally constructed from flexible plastic that will withstand many opening and closing functions and are sized so that, when the closure is closed, the outer surfaces of the hinges 30 do not protrude outwardly from the neck 50 more than the base rest 14. That is, the hinges 30 are sized so that they are flush with the largest outer diameter protrusion from the neck 50 of the container. This position and design of the double hinge 30 ensures that when the cap cover 20 is opened, the hinge 30 does not bend inward but stays flush with the outer diameter. The design of double hinge 30, in conjunction with thin membranes 35 and 37 and tear strip 22 provides a moisture and dust proof closure when the tear strip is attached. After removal of the tear strip, the double hinge serves to position the cap cover 20 such that the plane of the cap cover 20 is always perpendicular to the cross-sectional view of FIG. 2. This facilitates closing the closure by self-aligning the cap cover 20 to the top rim 9.

Between the cap cover 20 and the anchor band 23 along most of the circumference of the neck is a tear strip 22. The tear strip 22 is attached to the cap cover 20 and to the anchor band 23 by a thin plastic molding which is frangible. The tear strip 22 is easily torn from both the cap cover 20 and the anchor band 23 by pulling on the tear tab 29, shown in FIGS. 6 and 4, so as to completely remove the tear strip 22 from the closure and allow the normal operation of the cap cover 20. The closure cannot be opened until the tear strip is removed, thus making the closure tamper-evident. On the end of tear strip 22 to which tear tab 29 is attached is a thin membrane 37. On the other end of tear strip 22 is another thin membrane 37 that connects to the double hinge 30. The membranes 37 prevent any dirt or moisture from entering the interior of the closure. The membranes 37 tear away with the tear strip 22 when the tear strip 22 is torn off.

The tear tab 29 of the tear strip 22 extends away from the outer diameter so as to provide for a large area to grip the tear strip 22 to further facilitate tearing the tear strip 22 away. Gripping the normal sized tear tab is not difficult for the average person. However, for many people such a task is quite difficult. By enlarging the area of the tear tab 29 gripping it is greatly facilitated. The tear tab 29 is inclined vertically such that the plane of the tab 29 is perpendicular to the top 40 of the cap cover 20.

Figure 7:
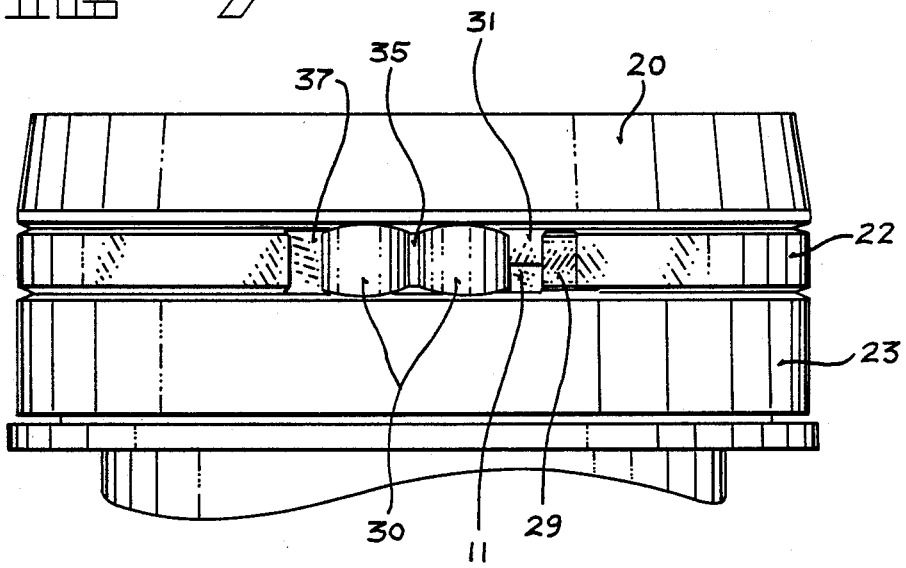
FIG. 7 is a view of the double hinge, tear tab and tear strip area.

In another embodiment shown in FIG. 7, a window notch 31 without a thin membrane covering is also provided for between the hinge 30 and the one end of the tear strip 22 with the tear tab 29. The window notch 31 is wide enough to allow for a tool (e.g. small screwdriver) or other such apparatus to aid in the tearing away of the tear strip 22. The window notch 31 works in conjunction with the groove 12 to aid in the removal of tear strip 22. The groove 12 behind the tear strip 22 provides additional space for an object such as a pencil to place itself in a position to apply leverage to the tear strip 22 and tear tab 29. Ordinarily, the removal of the tear strip by pulling tear tab 29 can be accomplished by an average person. However, for many people such an attempt would be difficult or impossible. By adding the window notch 31 without a thin plastic membrane, it is easier to remove the tear strip 22. Generally, however, the thin membrane 37 is preferred.

Figure 4:
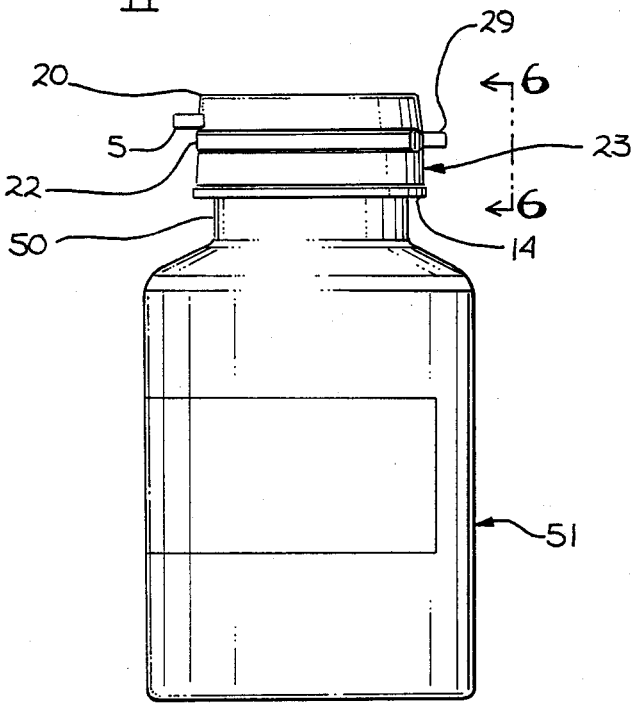
FIG. 4 is a picture of the container-closure combination with the tear strip attached and showing the vantage point of FIG. 6.

FIG. 4 shows the closure-container combination with the tear strip attached. The double lock bead system comprises of both the sealing rib 26 an the locking bead 28. The first lock is at the juncture of sealing rib 26 and cap latch 10, the second at the juncture of the locking bead 28 and the cap restraint 11. This double lock secures the cap cover 20 on the neck 50 of the container 51 such that it is impossible to remove the cap without clear evidence of tampering. With the above mentioned design, it is almost impossible to remove the entire closure apparatus without physically damaging the closure. Neither dirt or moisture may penetrate the closure with the tear strip attached and none of the membranes punctured.

Figure 3:
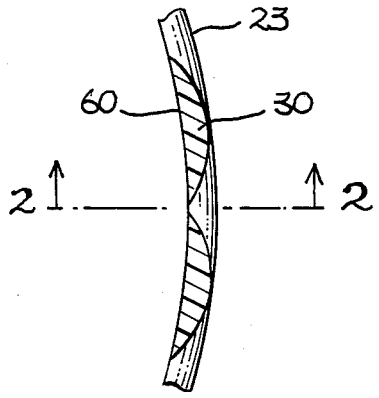
FIG. 3 is a cross-sectional view of the hinge area (only) taken along the line 3*a*—3*a* of FIG. 2.

The hinge area is designed as a double post hinge so that the hinge does not project inwardly but remains flush with the outer diameter as in FIG. 2. This makes for a stronger hinge and greater durability for opening and closing. A cross-sectional view of the hinge is shown in FIG. 3. The inside surface 60 of hinge 30 faces the bottle (neck of container). The outside surface of hinge 30, which faces away from the bottle, bulges out further forming a more concave curve than the inside surface of the hinge. The furthest point on the outside surface of the hinge is substantially aligned with the exterior surface of the anchor band 23.

Figure 5:
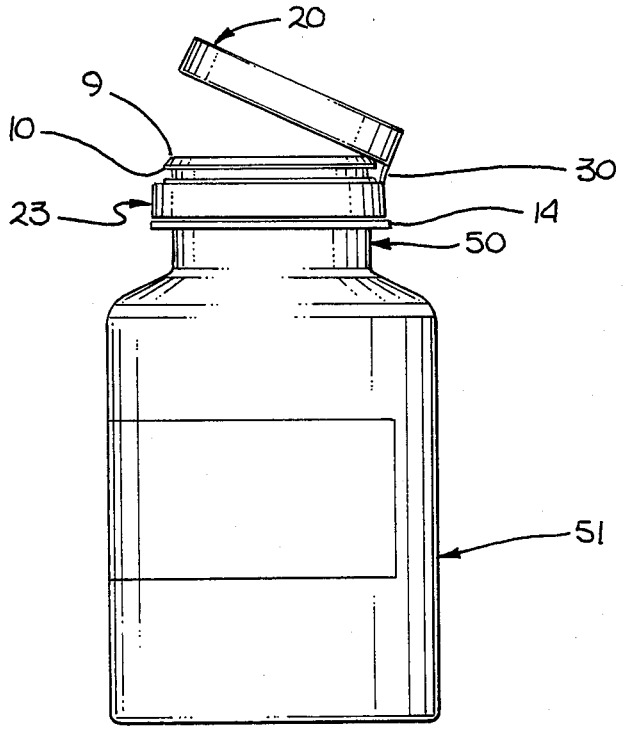
FIG. 5 is a picture of the container-closure combination with the cap detached from the upper rim of the neck (i.e. an open container).

FIG. 5 shows the closure-container after the removal of the tear strip, with the cap detached from the neck. The cap can be securely fastened, yet is easy to open and close. The double hinge is quite durable. It facilitates the opening and closing of the cap by properly aligning the cap. The anchor band is fitted so that there is almost no capacity for vertical movement of the closure. FIG. 6 shows the side of the container having the double hinge and tear strip. Tear-tab 29 extends outward from the outer diameter, allowing for enough gripping area for easy manual removal of the tear strip. The thin membranes 37 can be easily punctured and removed to facilitate the removing of the tear strip.

Thus an improved hinged closure for a container is described.

I claim:

1. A container and closure combination comprising:

a container having a neck terminating in a top rim defining a mouth with an external cap latch extending outwardly from said top rim of said neck, a cap restraint which protrudes externally from said neck below said cap latch so as to have a cavity between said cap latch and said cap restraint, a base ceiling which protrudes externally from said neck below said cap restraint so as to have a groove between said base ceiling and said cap restraint, a base rest which protrudes externally from said neck below said base ceiling so as to have a depression between said base ceiling and said base rest;

a closure having a cap cover, a tear strip, a hinge and an anchor band, said cap cover having a protruding circumferential exterior sealing flange that abuts the external circumference of the top rim, said cap cover having no other annular protrusion from the underside of the cap cover within the circumference of the top rim which serves to assist in forming a seal with said container, said cap cover having an inwardly facing sealing rib such that when said cap cover is closed on said container said sealing rib abuts and engages said cap latch to secure said cap cover on said container, said hinge connecting said cap cover to said anchor band, said anchor band being located in said depression between said base ceiling and said base rest to secure said closure to said container, said tear strip being attached to said cap cover and said anchor band over at least a portion of the circumference of said tear strip except for the portion of the circumference of said closure where a thin membrane and said hinge occurs, said tear strip having an inwardly protruding locking bead over at least a portion of the interior side of said tear strip, said locking bead cooperatively engaging said cap restraint to securely retain said cap cover on said container.

2. A container and closure combination as defined in claim 1, wherein said exterior sealing flange in conjunction with said top rim and said cap latch in conjunction with said sealing rib forms a flexible valve seal when said cap cover is closed over said top rim and wherein said hinge is a double hinge having two posts connecting said anchor band to said cap cover.

3. The container and closure combination as defined in claim 2, wherein one end of said tear strip extends away from said neck to form a tear tab so that an end of said tear strip is not connected to said cap cover or said anchor band, and wherein said tear strip has a thin membrane that is capable of puncture and removal covering a window notch of open space to allow for a tool or similar article to aid in removing said tear strip from said closure.

4. The container and closure combination as defined in claim 3, wherein, said double hinge is fabricated so as not to project from said neck beyond said base rest, said double hinge being composed of two posts flush to the largest outside diameter of said neck connected by a thin membrane.

5. The container and closure combination as defined in claim 4, wherein said cap restraint extends further outwardly from said neck than said cap latch.

6. The container and closure combination as defined in claim 5, wherein said base rest extends outwardly from said neck further than said cap restraint and wherein a foil-like disc is applied over said top rim to cover said mouth and said exterior sealing flange presses downwardly on the edge of said foil-like disc to secure said foil-like disc to said top rim.

7. A tamper evident closure and container combination comprising:

a container having a neck terminating in a top rim defining a mouth of circular shape, said neck including a cap latch circumferentially surrounding said top rim and extending downwardly and outwardly from said top rim of said neck, said cap latch having a first horizontally projected base, said neck further including a cap restraint which protrudes outwardly from said neck below said cap latch, said cap restraint circumferentially surrounding said neck, and having a downwardly slanting face and a second horizontally projected base, said cap restraint and said cap latch forming a cavity which circumferentially surrounds said neck between said cap restraint and said cap latch, said neck further including an anchor ceiling which protrudes outwardly from said neck below said cap restraint, said anchor ceiling circumferentially surrounding said neck, said cap restraint and said anchor ceiling forming a groove which circumferentially surrounds said neck between said cap restraint and said anchor ceiling, said neck further including an anchor floor which protrudes outwardly from said neck below said anchor ceiling, said anchor floor circumferentially surrounding said neck, said anchor ceiling and said anchor floor forming a depression which circumferentially surrounds said neck between said anchor ceiling and said anchor floor;

a closure comprising a cap cover, an anchor band, a double hinge and a tear strip, wherein, said cap cover includes a circular top which covers said mouth of said container and has a diameter larger than the outer diameter of said top rim, said cap cover further including an annular sidewall which projects downwardly from said circular top, and which includes a sealing rib which circumferentially surrounds said neck and which projects inwardly from said annular sidewall said sealing rib having an inner diameter which is less than the outer diameter of said cap latch so that said sealing rib tightly engages said cap latch when said closure is closed, said sealing rib projecting into said cavity and at least a portion of said sealing rib being located under said first horizontally projected base when said closure is closed, said circular top including an external sealing flange which protrudes from the underside of said circular top and which circumferentially surrounds said top rim, said cap cover having no other annular protrusion from the underside of said circular top within the circumference of the inner diameter of said top tim which serves to assist in forming a seal with said container, said external sealing flange having an inner diameter which is approximately equal to the outer diameter of said top rim so that, when said closure is closed, said external sealing flange tightly abuts the outer edge of said top rim to provide a liquid seal;

said anchor band includes an annular band which circumferentially surrounds and covers said depression around said neck, said anchor band being secured in place in said depression by said anchor ceiling and said anchor floor, said anchor ceiling engaging said anchor band to prevent upward movement and said anchor floor engaging said anchor band to prevent downward movement of said anchor band, said anchor band being connected to said double hinge which overlies a portion of said groove, said double hinge being two posts of flexible material being connected by a permanent membrane and having two ends, one end of said double hinge being connected to said anchor band and the other end being connected to said cap cover, each of said posts having an outside surface which faces away from said container and which is more concave than the inside surface of each of said posts;

said tear strip includes a strip which circumferentially surrounds and covers said groove around said neck except for the portion of said groove under said double hinge, said tear strip having an inwardly protruding locking bead over at least a portion of the interior side of said strip, said locking bead abutting said cap restraint and protruding into said groove so as to cooperatively engage said cap restraint to securely retain said cap cover on said container until said tear strip is removed from said closure, said tear strip being attached to said anchor band and said cap cover by a thin frangible molding, said tear strip having a thin membrane connecting said double hinge to said tear strip so that said tear strip and said double hinge completely cover said groove around said neck.

8. A closure and container combination as in claim 7 wherein, said cap cover further comprises an opening tab protruding outwardly from said annular sidewall and said tear strip further comprises a tear tab which protrudes outwardly from said tear strip.

9. A closure and container combination as in claim 8 wherein a foil-like disc is applied over said top rim to cover said mouth, and said external sealing flange presses downwardly on the outer edge of said foil-like disc to secure said foil-like disc to said top rim.

10. A tamper evident closure and container combination comprising:

a container having a neck terminating in a top rim defining a mouth of circular shape, said neck including a cap latch circumferentially surrounding said top rim and extending downwardly and outwardly from said top rim of said neck, said cap latch having a first horizontally projected base, said neck further including a cap restraint which protrudes outwardly from said neck below said cap latch, said cap restraint circumferentially surrounding said neck, and having a downwardly slanting face and a second horizontally projected base, said cap restraint and said cap latch forming a cavity which circumferentially surrounds said neck between said cap restraint and said cap latch, said neck further including an anchor ceiling which protrudes outwardly from said neck below said cap restraint, said anchor ceiling circumferentially surrounding said neck, said cap restraint and said anchor ceiling forming a groove which circumferentially surrounds said neck between said cap restraint and said anchor ceiling, said neck further including an anchor floor which protrudes outwardly from said neck below said anchor ceiling, said anchor floor circumferentially surrounding said neck, said anchor ceiling and said anchor floor forming a depression which circumferentially surrounds said neck between said anchor ceiling and said anchor floor;

a closure comprising a cap cover, an anchor band, a double hinge and a tear strip, wherein, said cap cover includes a circular top which covers said mouth of said container and has a diameter larger than the outer diameter of said top rim, said cap cover further including an annular sidewall which projects downwardly from said circular top, and which includes a sealing rib which circumferentially surrounds said neck and which projects inwardly from said annular sidewall said sealing rib having an inner diameter which is less than the outer diameter of said cap latch so that said sealing rib tightly engages said cap latch when said closure is closed, said sealing rib projecting into said cavity and at least a portion of said sealing rib being located under said first horizontally projected base when said closure is closed, said circular top including an external sealing flange which protrudes from the underside of said circular top and which circumferentially surrounds said top rim, said cap cover having no other annular protrusion from the underside of said circular top within the inner diameter of said top rim which serves to assist in forming a seal with said container, said external sealing flange having an inner diameter which is approximately equal to the outer diameter of said top rim so that, when said closure is closed, said external sealing flange tightly abuts the outer edge of said top rim to provide a liquid seal;

said anchor band includes an annular band which circumferentially surrounds and covers said depression around said neck, said anchor band being secured in place in said depression by said anchor ceiling and said anchor floor, said anchor ceiling engaging said anchor band to prevent upward movement and said anchor floor engaging said anchor band to prevent downward movement of said anchor band, said anchor band being connected to said double hinge which overlies a portion of said groove, said double hinge being two posts of flexible material being connected by a permanent membrane and having two ends, one end of said double hinge being connected to said anchor band and the other end being connected to said cap cover, each of said posts having an outside surface which faces away from said container and which is more concave than the inside surface of each of said posts;

said tear strip includes a strip which circumferentially surrounds and covers said groove around said neck except for the portion of said groove under said double hinge, said tear strip having an inwardly protruding locking bead over at least a portion of the interior side of said strip, said locking bead abutting said cap restraint and protruding into said groove so as to cooperatively engage said cap restraint to securely retain said cap cover on said container until said tear strip is removed from said closure, said tear strip being attached to said anchor band and said cap cover by a thin frangible molding.

* * * * *